US010069222B2

(12) United States Patent
Itou

(10) Patent No.: US 10,069,222 B2
(45) Date of Patent: Sep. 4, 2018

(54) TERMINAL STRUCTURE AND FEMALE TERMINAL

(71) Applicant: Sumitomo Wiring Systems, Ltd., Yokkaichi, Mie (JP)

(72) Inventor: Tomoya Itou, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/646,150

(22) Filed: Jul. 11, 2017

(65) Prior Publication Data

US 2018/0019528 A1 Jan. 18, 2018

(30) Foreign Application Priority Data

Jul. 15, 2016 (JP) ..... 2016-139904

(51) Int. Cl.

| | |
|---|---|
| ***H01R 13/187*** | (2006.01) |
| ***H01R 13/432*** | (2006.01) |
| ***H01R 11/11*** | (2006.01) |
| ***H01R 4/48*** | (2006.01) |

(Continued)

(52) U.S. Cl.

CPC ..... *H01R 11/11* (2013.01); *H01R 4/185* (2013.01); *H01R 4/48* (2013.01); *H01R 43/16* (2013.01)

(58) Field of Classification Search

CPC .. H01R 13/113; H01R 13/187; H01R 13/432; H01R 4/185; H01R 13/114; H01R 13/11; H01R 13/4223; H01R 13/434; H01R 13/53; H01R 43/16; H01R 4/184; H01R 13/111; H01R 13/112; H01R 13/115; H01R 13/14; H01R 13/18; H01R 13/20; H01R 13/24; H01R 13/35; H01R 13/428; H01R 13/4361; H01R 13/521; H01R 13/533; H01R 2101/00; H01R 24/20; H01R 4/48

USPC ..... 439/852, 843, 845, 851, 857, 748, 131, 439/140, 181, 839, 842, 849, 856, 879, 439/891

See application file for complete search history.

(56) References Cited

U.S. PATENT DOCUMENTS 6,203,385 B1 * 3/2001 Sato ..... H01R 13/113 439/852
6,439,935 B2 * 8/2002 Saka ..... H01R 13/113 439/842

(Continued)

FOREIGN PATENT DOCUMENTS

JP 2001-357922 12/2001

*Primary Examiner* — Michael A Lyons
*Assistant Examiner* — Matthew T Dzierzynski
(74) *Attorney, Agent, or Firm* — Gerald E. Hespos; Michael J. Porco; Matthew T. Hespos

(57) ABSTRACT

A male terminal (10) includes a tab (11) extending in a front-rear direction. A female terminal (60) includes a base (64) in the form of a flat plate extending in the front-rear direction, a contact piece (67) rising from one side of the base (64) and further curved so that a tip faces the base (64), and an opening (69) opens between the tip of the contact piece (67) and the base (64) on a side facing a rising part of the contact piece (67). The tab (11) includes a part configured to be sandwiched resiliently between the base (64) and the contact piece (67) and contacts a leading end edge of the contact piece (67) along the front-rear direction when the male and female terminals (10, 60) are connected and a part projecting laterally outwardly through the opening (69).

14 Claims, 3 Drawing Sheets

(51) Int. Cl.
*H01R 4/18* (2006.01)
*H01R 43/16* (2006.01)

(56) References Cited

U.S. PATENT DOCUMENTS

| | | | | |
|---|---|---|---|---|
| 6,579,132 | B2 * | 6/2003 | Sato | H01R 13/113 439/852 |
| 7,014,515 | B2 * | 3/2006 | Lutsch | H01R 13/113 439/843 |
| 7,717,759 | B2 * | 5/2010 | Ishigami | H01R 4/184 439/748 |
| 8,366,494 | B2 * | 2/2013 | Nishide | H01R 13/113 439/752.5 |
| 8,616,925 | B2 * | 12/2013 | Kobayashi | H01R 13/113 439/845 |
| 8,708,719 | B2 * | 4/2014 | Iihoshi | H01R 13/434 439/131 |
| 8,790,143 | B2 * | 7/2014 | Yang | H01R 13/14 439/852 |
| 8,795,007 | B2 * | 8/2014 | Itou | H01R 13/20 439/852 |
| 8,974,256 | B2 * | 3/2015 | Okano | H01R 13/113 439/852 |
| 9,118,130 | B1 * | 8/2015 | Volpone | H01R 13/115 |
| 9,318,825 | B2 * | 4/2016 | Taguchi | H01R 13/113 |
| 9,478,875 | B2 * | 10/2016 | Il | H01R 4/48 |
| 9,735,490 | B2 * | 8/2017 | Wu | H01R 13/24 |
| 2004/0106333 | A1 * | 6/2004 | Zhao | H01R 13/53 439/843 |
| 2004/0116002 | A1 * | 6/2004 | Rozet | H01R 13/187 439/843 |

* cited by examiner

TERMINAL STRUCTURE AND FEMALE TERMINAL

BACKGROUND

1. Field of the Invention

The invention relates to a terminal structure and to a respective female terminal.

2. Description of the Related Art

Japanese Unexamined Patent Publication No. 2001-357922 discloses a terminal structure with a male terminal and a female terminal to be connected to each other. The male terminal includes a tab extending along a front-rear direction. The female terminal includes a fitting portion of rectangular cross-section and into which the tab is to be fit. A resiliently deformable tongue projects in the fitting portion. The tab is inserted into the fitting portion and is sandwiched resiliently between the tongue and a ceiling surface of the fitting portion, thereby being electrically connected to the female terminal.

Small terminals have small tongues that exert a reduced resilient force and it may not be possible to obtain a high contact pressure for the tab. Further, if an axial center of a tab of a small terminal is deviated, even slightly, with respect to a fitting portion, the influence of such a positional deviation becomes significant and there is a problem that a contact position of the tab and a tongue cannot be determined stably.

The invention was completed based on the above situation and aims to ensure a high contact load and to be unaffected by a positional deviation of a tab.

SUMMARY

The invention relates to a terminal structure with a male terminal and a female terminal to be connected to each other. The male terminal includes a tab substantially extending in a front-rear direction. The female terminal includes a base in the form of a substantially flat plate extending in the front-rear direction. A contact piece rises from one side edge of the base and is curved so that a tip is arranged to face the base. An opening is open between the tip of the contact piece and the base portion on a side substantially facing a rising part of the contact piece. The tab includes a part configured to be sandwiched resiliently between the base and the contact piece and to contact a leading end edge of the contact piece along the front-rear direction when the male and female terminals are connected and a part projecting laterally outwardly through the open portion.

A part of the tab that contacts the leading end edge of the contact piece along the front-rear direction may be provided with a stepped stopper surface configured to contact the contact piece in a direction so that the tab exits through the opening. According to this configuration, a positional deviation of the tab in the direction to exit through the opening can be restricted, such as during vibration, and a contact position of the terminals can be determined stably.

The female terminal includes a rising portion and an arcuate portion between the base and the contact piece.

The base, the rising portion and the arcuate portion are formed continuously in a circumferential direction.

The rising portion may rise substantially at a right angle to one end edge of the base.

A tapered chamfer may be provided on a front edge of the tip of the arcuate portion.

The connecting portion may be open laterally outward as the opening substantially at a position between the tip of the arcuate portion and the base on a side substantially facing the rising portion.

A height of the opening may be slightly smaller than a height between a lower surface of the tab and a base surface of a receiving portion of the tab when the contact piece is in a natural state.

The invention also relates to a female terminal connectable with a male terminal that includes a tab. The female terminal includes a base in the form of a substantially flat plate extending in a front-rear direction. A contact piece rises from one side edge of the base and is curved so that a tip is arranged to substantially face the base portion. An opening is open between the tip of the contact piece and the base on a side substantially facing a rising part of the contact piece. The female terminal is configured to sandwich a part of the tab resiliently between the base and the contact piece and a leading end edge of the contact piece along the front-rear direction contacts the tab. A part of the tab projects laterally out through the open portion, when the female terminal is connected to the male terminal.

The female terminal may further include a rising portion and an arcuate portion between the base and the contact piece. The base, the rising portion and the arcuate portion may be formed continuously in a circumferential direction. The rising portion may rise substantially at a right angle to one edge of the base.

The tab has the part configured to be sandwiched resiliently between the base and the contact piece and to contact the leading end of the contact piece along the front-rear direction when the male and female terminals are connected. Thus, a high contact load is ensured even if the terminals are small. Further, the tab includes the part projecting laterally out through the opening. Thus, centering between the terminals is not necessary and the terminals can have a structure unlikely to be affected by a positional deviation of the tab.

These and other features and advantages of the invention will become more apparent upon reading the following detailed description and accompanying drawings. It should be understood that even though embodiments are described separately, single features thereof may be combined to additional embodiments.

BRIEF DESCRIPTION OF THE INVENTION

DETAILED DESCRIPTION

A first embodiment is described with reference to FIGS. 1 to 3. A terminal structure according to this first embodiment includes a male terminal 10 and a female terminal 60 to be connected to each other. The male terminal 10 is to be arranged in an unillustrated male housing. Similarly, the female terminal 60 is to be arranged in an unillustrated female housing. By connecting the both housings to each other, the male terminal 10 and the female terminal 60 are electrically connected to each other. Particularly, in the case of this first embodiment, the male terminal 10 and the female terminal 60 are configured in very small size.

Figure 2:
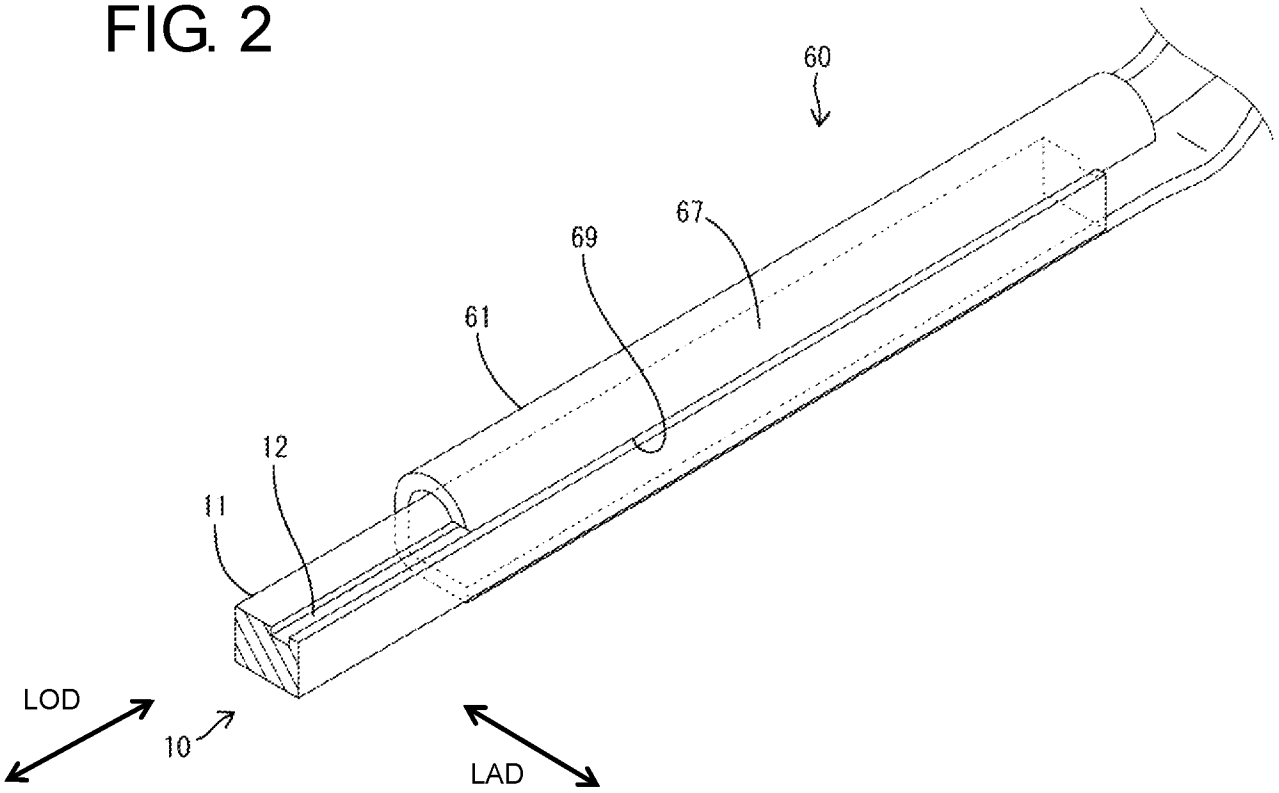
FIG. 2 is a perspective view showing a connected state of a male terminal and the female terminal.
Figure 3:
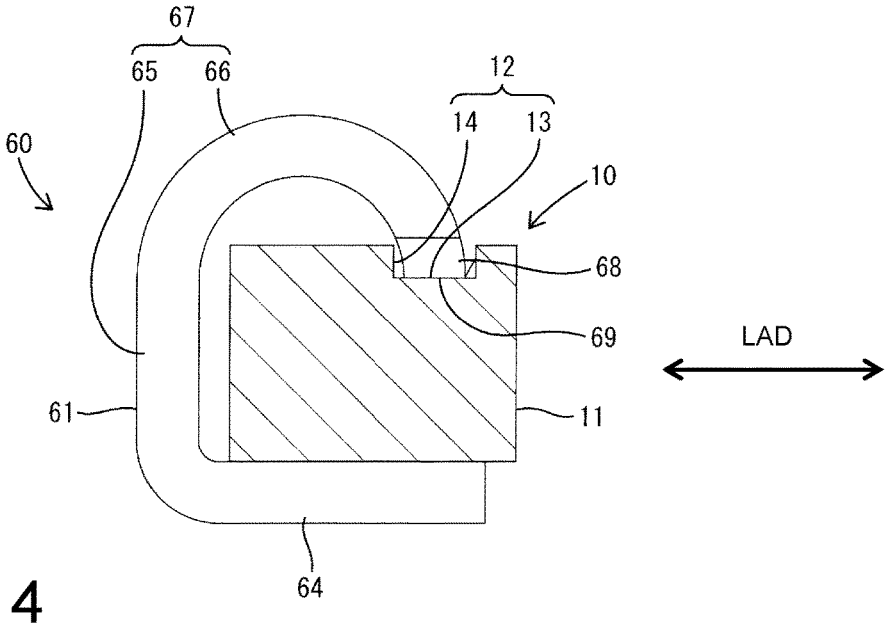
FIG. 3 is a front view in section of an essential part showing the connected state of the male terminal and the female terminal.

The male terminal 10 is made of conductive metal and includes, as shown in FIG. 2, a long narrow solid tab 11. The tab 11 extends in a connecting or front-rear direction (longitudinal direction LOD) and has a substantially rectangular cross-section. Upper and lower surfaces of the tab 11 are arranged along a lateral direction LAD except at a receiving portion 12 of the upper surface (to be described later). Left and right surfaces of the tab 11 are substantially vertical. A lateral dimension of the upper and lower surfaces of the tab 11 is longer than a vertical dimension of the left and right surfaces.

The upper surface of the tab 11 is recessed at a position closer to one side (right side of FIG. 3) than a lateral center to form the receiving portion 12 for receiving the tip of a later-described contact piece 67 of the female terminal 60. The receiving portion 12 extends over the entire length of the tab 11 in the front-rear direction (longitudinal direction LOD) and defines a shallow recess of rectangular cross-section with a bottom surface 13 extending along the lateral direction LAD and two vertical side surfaces. The left side surface of FIG. 3 defines a stopper surface 14 for restricting a lateral or rightward positional deviation of the tab 11 with respect to the female terminal 60.

The female terminal 60 is formed by bending, embossing and/or folding a conductive metal plate punched out into a predetermined shape, and shaped to be long and narrow in the front-rear direction. As shown in FIG. 1, the female terminal 60 has a connecting portion 61 in a front part and has a wire barrel 62 and an insulation barrel 63 in a rear part. The connecting portion 61 is to be connected to the tab 11 of the male terminal 10 substantially along the longitudinal direction LOD. The wire barrel 62 is crimped and electrically connected to a core 91 exposed at the end part of the wire 90. The insulation barrel 63 is located behind the wire barrel 62 and is crimped and mechanically connected to a coating 92 at the end part of the wire 90.

The connecting portion 61 is long and narrow with a length equal to or slightly longer than half the entire length of the female terminal 60 in the front-rear direction. As shown in FIG. 3, the connecting portion 61 includes a base 64 in the form of a flat plate, a rising portion 65 rising from a side edge of the base 64 that extends along the front-rear direction (longitudinal direction LOD) and an arcuate portion 66 that is curved substantially semicircularly from an upper end part of the rising portion 65 and hanging down such that a tip faces the other side edge side of the base 64 from above. The base 64, the rising portion 65 and the arcuate portion 66 are formed continuously in a circumferential direction.

Figure 1:
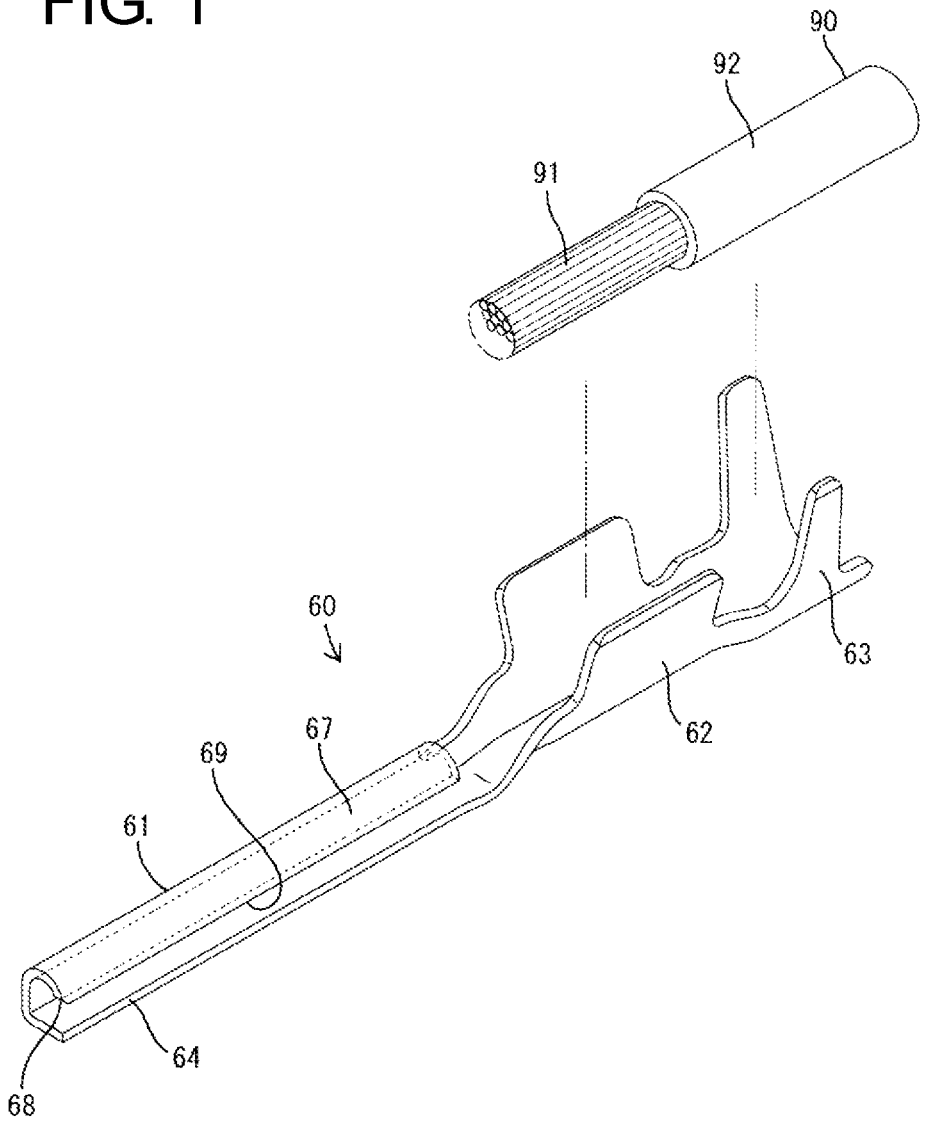
FIG. 1 is a perspective view of a female terminal of a terminal structure according to a first embodiment of the present invention.

As shown in FIG. 1, the base 64 is continuous with bottom plate parts of the wire barrel 62 and the insulation barrel 63, and the rising portion 65 is continuous with side plate parts of the wire barrel 62 and the insulation barrel 63. As shown in FIG. 3, the rising portion 65 rises substantially at a right angle from one side of the base 64. The rising portion 65 and the arcuate portion 66 collectively define the contact piece 67, and the contact piece 67 is deflectable and deformable with the base 64 as a support. A tapered chamfer 68 is provided on the front edge of the tip of the arcuate portion 66.

The connecting portion 61 is open laterally outward as an opening 69 at a position between the tip of the arcuate portion 66 and the upper surface of the base 64 on a side facing the rising portion 65. The tip of the arcuate portion 66 and the upper surface of the base 64 are arranged substantially in parallel along the front-rear direction (longitudinal direction LOD) except at the chamfer 68, and the opening 69 is continuous in the front-rear direction (longitudinal direction LOD) at substantially the same height and is open also on both front and rear ends of the connecting portion 61. A height (vertical dimension) of the opening 69 is slightly smaller than a height between the lower surface of the tab 11 and the bottom surface 13 of the receiving portion 12 when the contact piece portion 67 is in a natural state.

Next, a connection method and a connection structure of the male terminal 10 and the female terminal 60 are described.

The wire 90 is connected to the wire barrel 62 and the insulation barrel portion 63 of the female terminal 60 prior to the connection of the male terminal 10 and the female terminal 60. More particularly, plural female terminals 60 are mounted in the female housing and plurality male terminals 10 are mounted in the male housing.

Subsequently, the housings are connected to each other. In the process of connecting the housings, the receiving portion 12 of the tab 11 of the male terminal 10 slides on the chamfer 68 of the female terminal 60, and the contact piece 67 is deflected and deformed somewhat. In that state, the tip of the arcuate portion 66 of the female terminal 60 is inserted into the receiving portion 12 and slides in contact with the bottom surface 13 so that a connecting operation of the terminals 10, 60 is guided along the receiving portion 12. Further, an end part of the tab 11 to the right of the receiving portion 12 in FIG. 3 protrudes laterally out through the opening 69.

When the housings are connected properly, the tip of the arcuate portion 66 of the female terminal 60 is in contact with the bottom surface 13 of the receiving portion 12 over a long distance in the front-rear direction (longitudinal direction LOD), as shown in FIG. 2, and the terminals 10, 60 are connected electrically with a high contact load. Further, the end part of the tab 11 projects laterally out through the opening 69. Thus, axial centers of the tab 11 and the connecting portion 61 are deviated in a width direction (lateral direction LAD). Both terminals 10, 60 are allowed to deviate within clearances between the tip of the arcuate portion 66 and the side surfaces of the receiving portion 12. Thus, the axial centers of the both terminals 10, 60 need not be strictly aligned and can be used for small-size terminals easily affected by a positional deviation.

If the tab 11 is going to be deviated in a direction to exit through the opening 69 of the connecting portion 61 (right in FIG. 3) due to vibration in the surrounding (e.g. engine vibration or the like), the stopper surface 14 of the receiving portion 12 contacts the inner surface of the tip side of the arcuate portion 66 to restrict a positional deviation of the tab 11.

Figure 4:
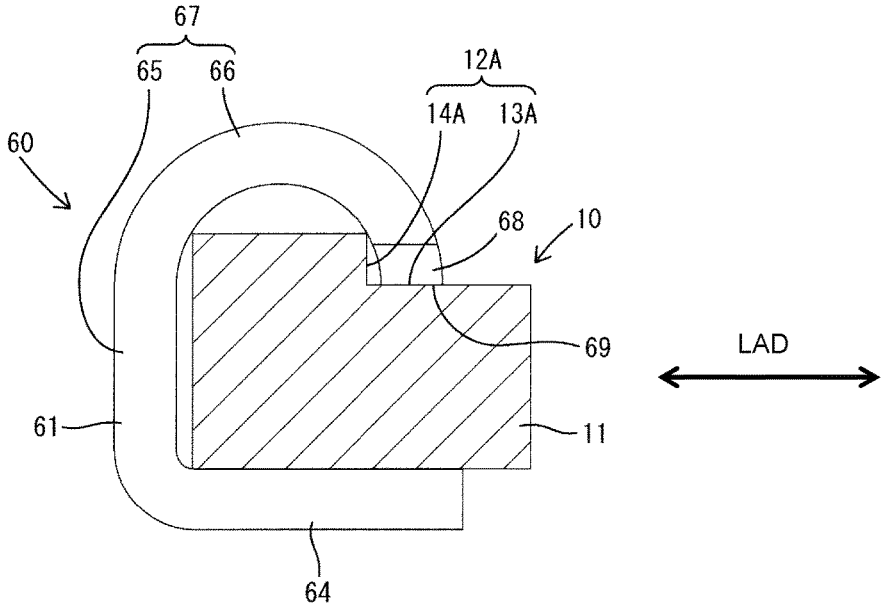
FIG. 4 is a front view in section of an essential part showing a connected state of a male terminal and a female terminal according to a second embodiment of the present invention.

FIG. 4 shows a second embodiment of the invention. In the case of the second embodiment, a receiving portion 12A of a male terminal 10 is shaped differently than in the first embodiment, but the other configuration is similar to that of the first embodiment. Parts identical to or equivalent to those of the first embodiment are denoted by the same reference signs and repeated description is omitted.

The receiving portion 12A is a recess formed by cutting corner of FIG. 4 on the upper surface of a tab 11. This receiving portion 12A has a bottom surface 13A extending along a lateral direction and a stopper surface 14A extending vertically and substantially perpendicular to the bottom surface 13A to define an L-shape cross-section that is open on a side facing the stopper surface 14A.

In the case of the second embodiment, since the bottom surface 13A of the receiving portion 12A is larger in a width direction than in the first embodiment, the tip of the arcuate portion 66 is received reliably by the receiving portion 12A and a positional deviation between the tab 11 and a connecting portion 61 can be absorbed more easily.

Note that, the tip of the arcuate portion 66 is held in contact with the bottom surface 13A of the receiving portion 12A. Thus, a movement of the tab 11 in a direction to exit through an opening 69 is restricted as in the first embodiment.

Other embodiments are briefly described below.

The tab may not have the receiving portion and the upper surface may be flat and continuous in the width direction without unevenness.

The contact piece may not include the rising portion and only the arcuate portion having an arcuate shape may extend from one side edge of the base.

REFERENCE SIGNS

10 . . . male terminal
11 . . . tab
12, 12A . . . receiving portion
14, 14A . . . stopper surface
60 . . . female terminal
61 . . . connecting portion
65 . . . rising portion (rising part)
69 . . . opening
90 . . . wire

What is claimed is:

1. A terminal structure with a male terminal and a female terminal to be connected to each other, wherein:

the male terminal includes a tab substantially extending in a front-rear direction;

the female terminal includes a base substantially in the form of a flat plate having a free side edge extending in the front-rear direction, a contact piece rising from a side of the base opposite the free side edge of the base and having a contact edge at an end of the contact piece remote from the base, the contact edge extending in the front-rear direction, the contact piece being curved so that the contact edge is substantially parallel to and spaced from the base and substantially faces the base, so that an elongated opening extends in the front-rear direction between the contact edge of the contact piece and the base on a side of the base substantially opposite a side of the base from which the contact piece rises from the base; and the tab includes a part configured to be sandwiched resiliently between the base and the contact edge of the contact piece and to contact the contact edge of the contact piece along the front-rear direction when the male and female terminals are connected and a part of the tab projecting laterally out through the elongated opening in a lateral direction that is transverse to the front-rear direction.

2. The terminal structure of claim 1, wherein the contact piece includes a rising portion that defines a part of the contact piece rising from a side of the base opposite the free side edge of the base and the contact piece further including an arcuate portion opposed to the base and extending from the rising portion to the contact edge.

3. The terminal structure of claim 2, wherein the part of the tab configured to contact the contact edge of the contact piece along the front-rear direction has a stepped stopper surface facing away from the base and defining a thin region of the tab that is configured to contact the contact edge of the contact piece in such a direction that the tab exits through the opening in the lateral direction transverse to the front-rear direction, the stepped stopper surface of the further defining a thick region of the tab that is disposed between the contact image and the rising portion of the contact piece of the female terminal.

4. The terminal structure of claim 2, wherein the base, the rising portion and the arcuate portion are formed continuously in a circumferential direction.

5. The terminal structure of claim 2, wherein the rising portion is substantially at a right angle to the base.

6. The terminal structure of claim 2, wherein a tapered chamfer is provided on a front end of the contact edge.

7. The terminal structure of claim 2, wherein the opening between the contact edge of the arcuate portion and the base on a side substantially opposite the rising portion.

8. The terminal structure of claim 1, wherein a height of the opening is slightly smaller than a height between a lower surface of the tab and a base surface of a receiving portion of the tab when the contact piece portion is in a natural state.

9. A female terminal connectable with a male terminal including a tab, wherein the female terminal comprises:

a base substantially in the form of a flat plate extending in a front-rear direction and having a free side edge, a contact piece having a rising portion rising from a side of the base opposite the free side edge and a curved portion extending from an end of the rising portion remote from the base, the curved portion having a free contact edge extending in the front-rear direction and arranged to substantially face the base, and an elongated opening between the free contact edge of the contact piece and the base being defined on a side substantially opposite the rising portion of the contact piece, the elongated opening extending in the front-rear direction;

wherein the female terminal is configured to sandwich a part of the tab resiliently between the base and the contact edge of the contact piece along the front-rear direction, and a part of the tab projecting laterally out through the opening in a direction transverse to the front rear direction, when the female terminal is connected to the male terminal.

10. The female terminal of claim 9, wherein the rising portion is aligned at a substantially right angle to the base.

11. The female terminal of claim 10, wherein the rising portion and the base are joined along a fold line that extends in the front-rear direction.

12. The female terminal of claim 9, wherein the rising portion extends substantially parallel to the front-rear direction.

13. The female terminal of claim 9, wherein the free side edge of the base and the contact edge of the contact piece are substantially parallel.

14. The terminal structure of claim 2, wherein the rising portion extends substantially parallel to the front-rear direction.

* * * * *